US006185871B1

(12) United States Patent
Wang

(10) Patent No.: US 6,185,871 B1
(45) Date of Patent: Feb. 13, 2001

(54) DOOR STRUCTURE

(76) Inventor: Hui-Tung Wang, 155 Kuang Mein Rd., San Chong City, Taipei (TW)

( * ) Notice: Under 35 U.S.C. 154(b), the term of this patent shall be extended for 0 days.

(21) Appl. No.: 09/246,707

(22) Filed: Feb. 9, 1999

(51) Int. Cl.[7] ..... E06B 3/00
(52) U.S. Cl. ..... 49/501; 293/341.17
(58) Field of Search ..... 49/304, 305, 306, 49/307, 308, 309, 316, 317, 318, 319, 320, 394, 503, 400, 501; 292/87, 128, 341.15, 341.17

(56) References Cited

U.S. PATENT DOCUMENTS

| | | | | |
|---|---|---|---|---|
| 313,742 | * | 3/1885 | Kintner | 49/304 |
| 319,121 | * | 6/1885 | Power | 49/304 |
| 507,922 | * | 10/1893 | Ohaver | 49/304 |
| 524,427 | * | 8/1894 | Vanvactor | 49/304 |
| 534,806 | * | 2/1895 | Stover | 49/304 |
| 551,250 | * | 12/1895 | Ballheim | 49/304 |
| 564,206 | * | 7/1896 | Loveland | 49/304 |
| 1,794,887 | * | 3/1931 | Emler | 49/304 |
| 1,891,073 | * | 12/1932 | Warner | 49/304 |
| 3,126,051 | * | 3/1964 | Sussin | 49/304 |
| 3,977,711 | * | 8/1976 | Lajcak | 292/202 |
| 4,348,836 | * | 9/1982 | Dumenil et al. | 49/310 |

* cited by examiner

*Primary Examiner*—Daniel P. Stodola
*Assistant Examiner*—Curtis A. Cohen
(74) *Attorney, Agent, or Firm*—Bacon & Thomas, PLLC

(57) ABSTRACT

A door structure primarily consists of a door leaf, a door frame, a retaining piece, and a retaining mechanism. The door leaf has a wedged side corresponding to a slant side surface of the door frame and a groove formed on the opposite side surface. The retaining piece, disposed in the groove of the door leaf, has a supporting portion on one side and a retaining portion on the other side. The front end of the retaining portion extends to form a mating portion. The retaining mechanism is composed of a latching device and an actuating device. The latching device is provided with a transverse lock rod, an upper lock rod, and a lower lock rod. These lock rods can be urged to move by an actuating rod of the actuating device. When closing the door leaf, the actuating rod of the actuating device is depressed into the door leaf and the transverse lock rod, the upper lock rod, and the lower lock rod of the door leaf and extend into the holes of the door frame.

23 Claims, 16 Drawing Sheets

DOOR STRUCTURE

BACKGROUND OF THE INVENTION (a) Field of the Invention

The present invention relates to an improved door structure, especially to the improvements made on a structure of fireproof doors, entrance doors, emergency doors, and acoustical isolation doors. The improved door structure has better performances in protection against fires, smoke and acoustical penetration. It can give better security to prevent invasion.

(b) Description of the Prior Art

Conventional door structures adopt right corners on the periphery of door leaves and door frames. Such door structures are easier to be opened by inserting a tool into the gaps between a door leaf and its door frame to pry the door open. In addition, when external forces hit such a door structure, the door leaf and the door frame deform easier. Furthermore, if chain locks and do or hinges loosen due to destruction by external forces or rustiness, the door leaf of a conventional door structure will easily separate from the door frame and fall flat, which might produce casualties. Such possibilities must be eliminated, especially for children. Moreover a metal door will expand when heated. Thus when the house is on fire, the door leaf and the door frame will deform. The right corner design of conventional door structures makes the door leaf and the door frame stuck to each other easier. This may lead to the blockade of emergency exits. Besides, conventional door structures often allow gaps between the boundaries of a door leaf and a door frame to make opening easier and smooth. The gaps are detrimental to the effect of preventing smoke penetration. Conventional door structures are provided with lock means to join a door leaf with a door frame when door is closed to prevent thief's or stranger's invasion. The lock means should be preferably provided with features of preventing destruction by external forces. Conventional door structures usually have one single lock or latch. Such lock means are easier to be broken. As a result they can not provide better protection against the invasion.

SUMMARY OF THE INVENTION

The primary object of the invention is to provide a door structure in which one pair of the mated side surfaces of the door leaf and the door frame adopts a slant surface arrangement. When the door is closed, the other side surface of the door leaf abuts closely against a retaining plate of the door frame. Thus the door leaf and the door frame can press against each other. Furthermore, when someone tries to pry the door leaf, the slant mated surfaces of the door leaf and the frame will prevent the door from being opened. As a result, the door structure according to the invention has better security.

Another object of the invention is to provide a door structure that will not deform easily as it suffers impacts from external forces and contrarily will form closer joining between the door leaf and the door frame. Therefore the door structure according to the invention will not be broken easily.

Another object of the invention is to provide a door structure in which the gaps between the door leaf and the door frame can be minimized because the adjacent surfaces between them are slant. Thus the door structure according to the invention has excellent performances in protection against fire, and smoke and acoustical penetration.

Another object of the invention is to provide a door structure of which the retaining means have multiple locking effects. The door leaf of the inventive structure can be automatically locked at several places by the retaining mechanisms of the door frame. Thus the locking can not be easily destroyed by outside violence and the door provides better protection against outside invasion.

DETAILED DESCRIPTION OF THE PREFERRED EMBODIMENTS

Figure 1:
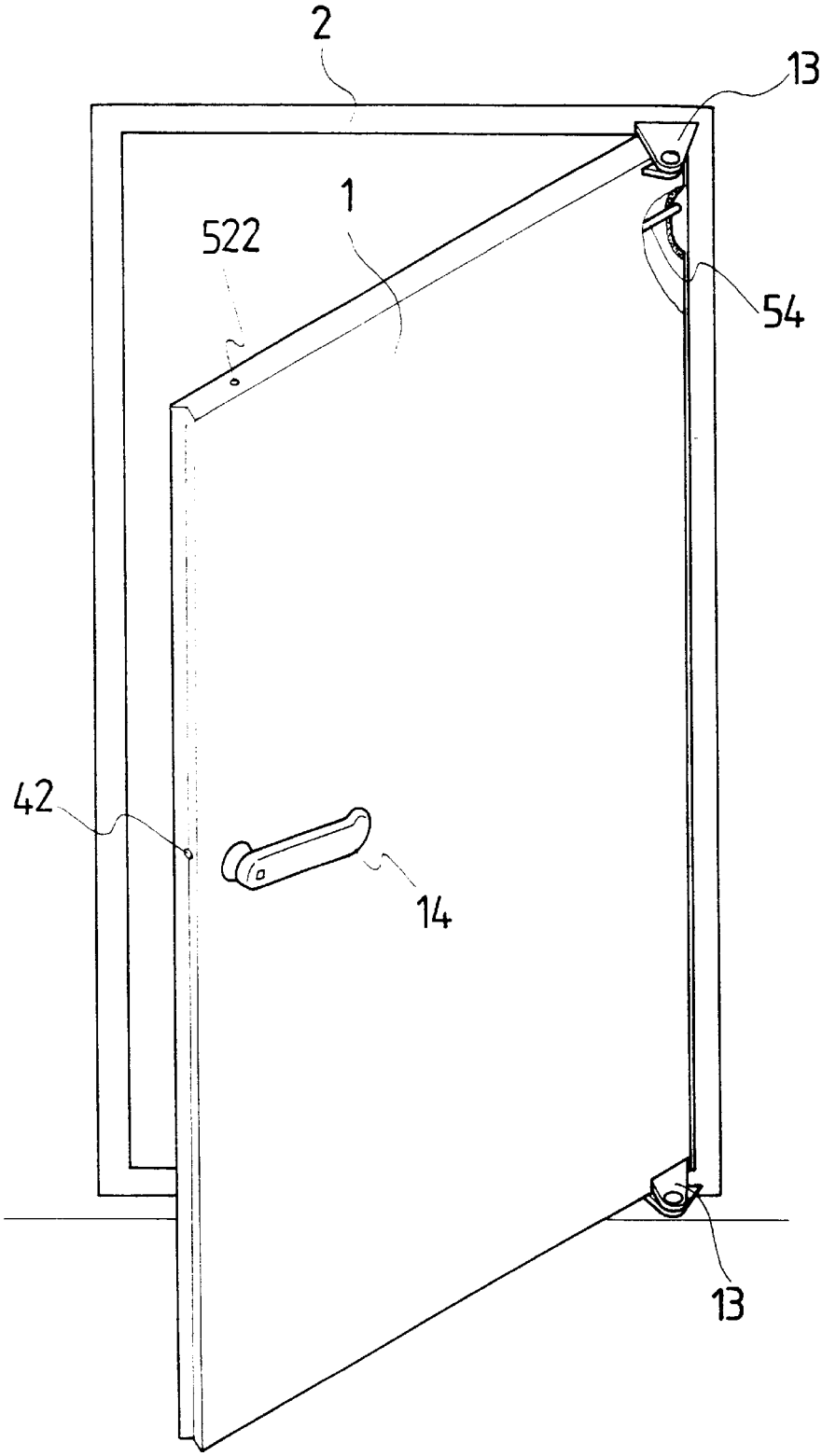
FIG. 1 is a perspective view showing the outer appearance of an embodiment of a door according to the invention.
Figure 2:
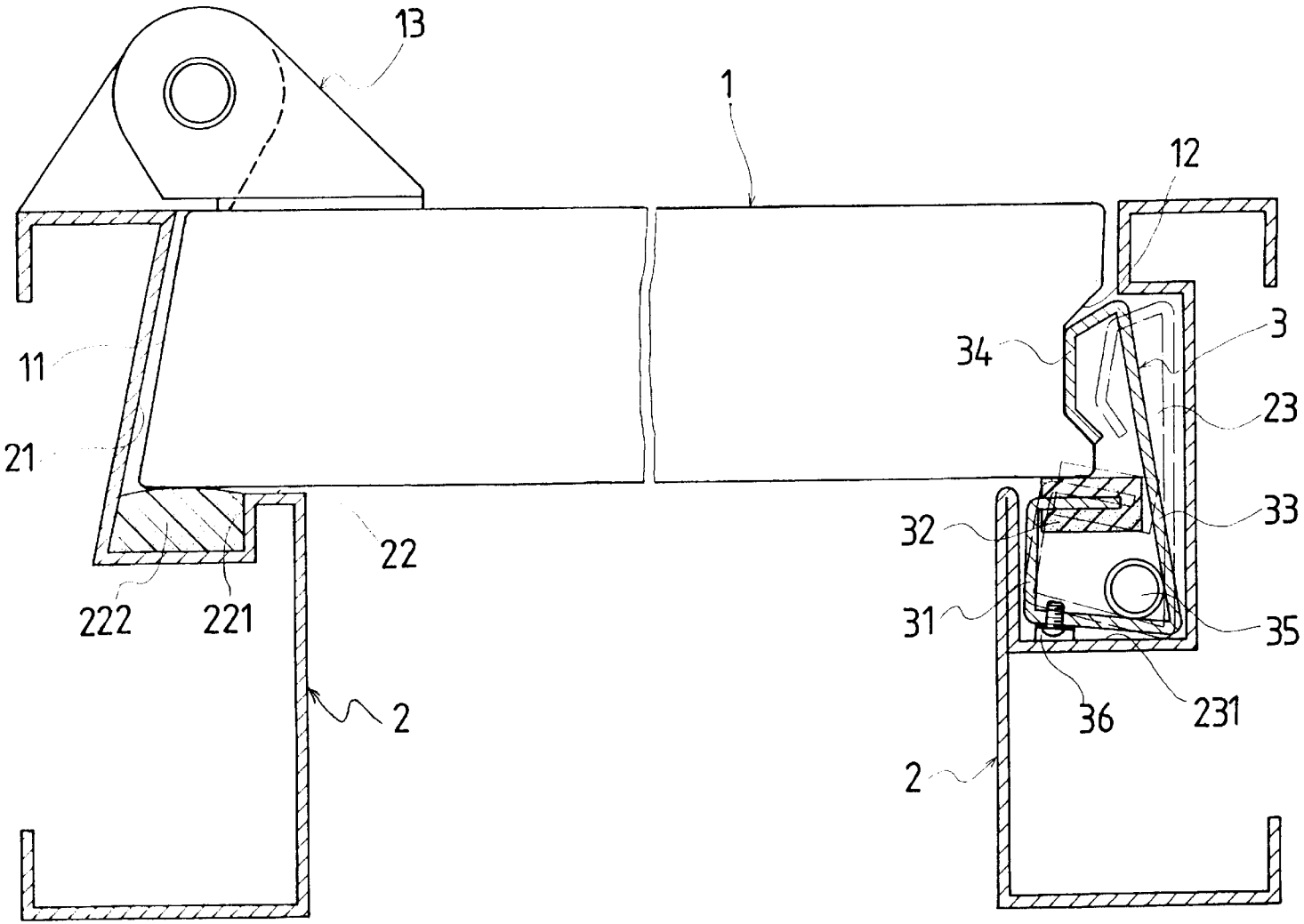
FIG. 2 is a partial cross sectional view taken along the header of the door frame showing the door leaf in a closed position, the door frame and the retaining plate in an assembled state.
Figure 10:
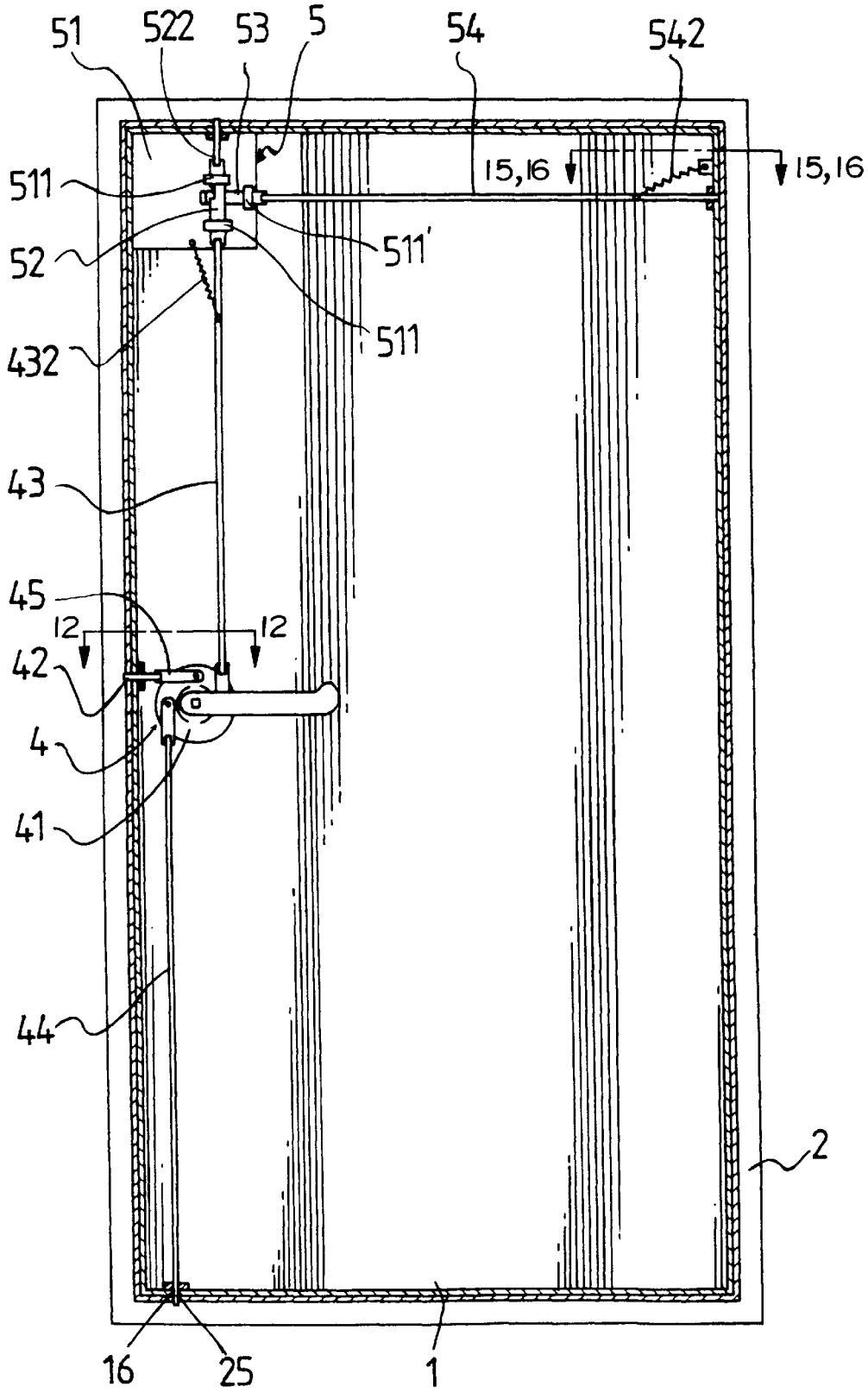
FIG. 10 is a cross sectional view schematically indicating the retaining mechanism of the invention.

As shown in FIGS. 1, 2, and 10, the door structure of the invention comprises a door leaf 1, a door frame 2, a retaining plate 3, and a retaining mechanism.

The door leaf 1 mainly consists of a plate-like body with one side wedged surface 11. The door leaf is pivotally connected at the wedged side to a door frame 2 by means of a hinge 13 and has a groove 12 at the opposite side.

The door frame 2, which is a rectangular frame sized to embrace a door leaf 1, has a slant surface 21 disposed on the side thereof pivotally connected to the door leaf 1. The slant surface 21 has an inclination designed to mate with the corresponding angled or wedged surface 11 of the door leaf 1. There is a resilient buffer 222 arranged in the slot 221 of the stopper surface 22 of the door frame 2. The other side of the door frame 2 includes a long groove 23, which is provided with a pivot pin hole 24 on both of the upper and the lower end.

The retaining plate 3 is primarily composed of a formed steel sheet. The retaining plate 3 has a generally C-shaped supporting portion 31 on the rear end. Rubber packing 32 embraces the rear end of the steel sheet. The other end of the steel sheet extends to form an inclined retaining portion 33 and further extends to form a mating portion 34, which has generally a barb-like profile. The retaining plate 3 is further provided on the upper and the lower end at the joint between the retaining portion 33 and the supporting portion 31 with a small round pivot pin 35. The supporting portion 31 also provides space for fixing trapezoidal plate springs 36 on the external back walls thereof.

The retaining mechanism, as shown in FIG. 10, consists of a latching device 4 and an actuating device 5 respectively disposed inside the door leaf 1. Closing the door leaf 1 can automatically interlock the door leaf with the door frame 2 by means of the latching device 4 and the actuating device 5.

Figure 11:
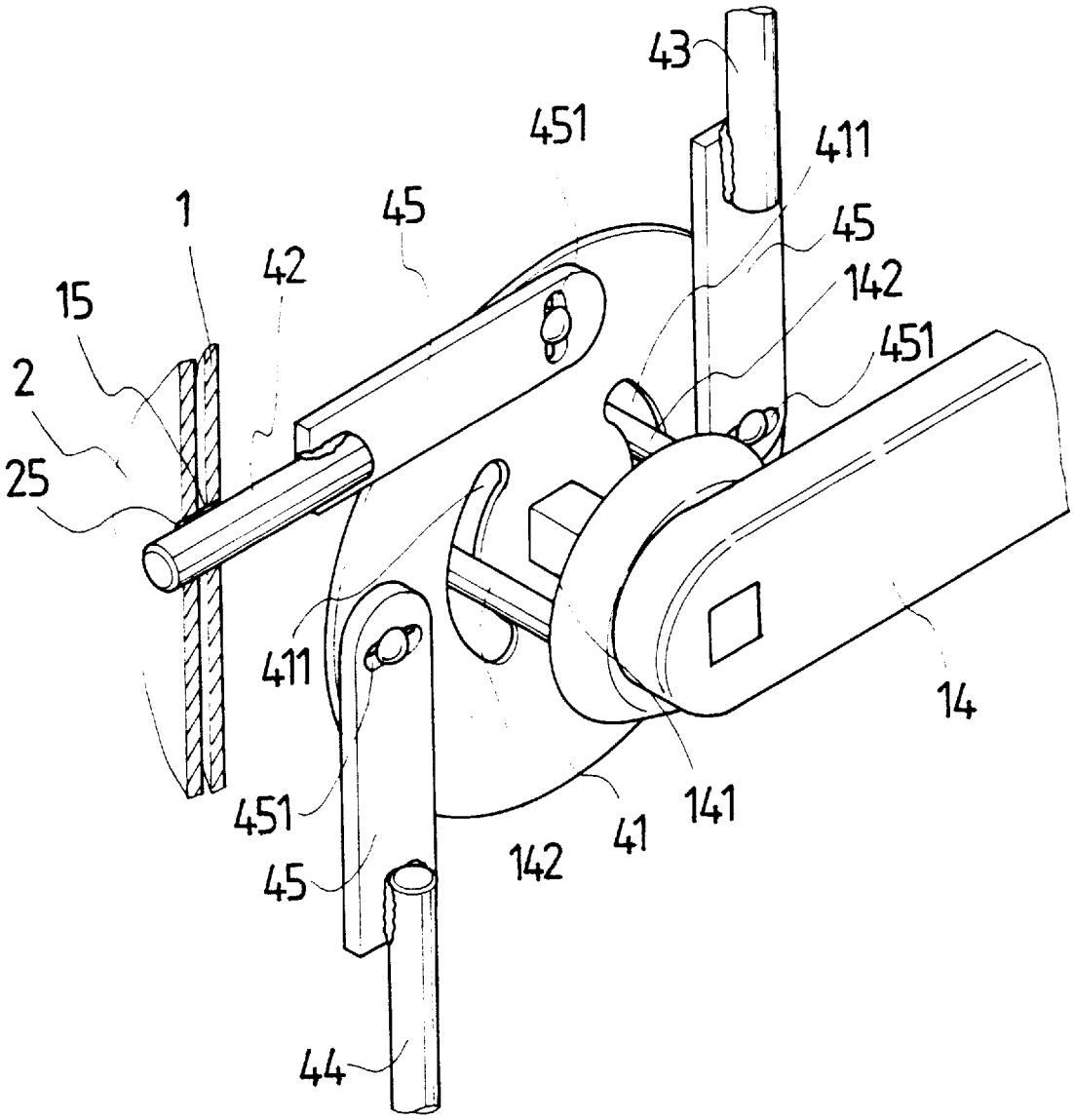
FIG. 11 is a perspective view partially depicting the arrangement of the retaining mechanism of the invention.
Figure 12:
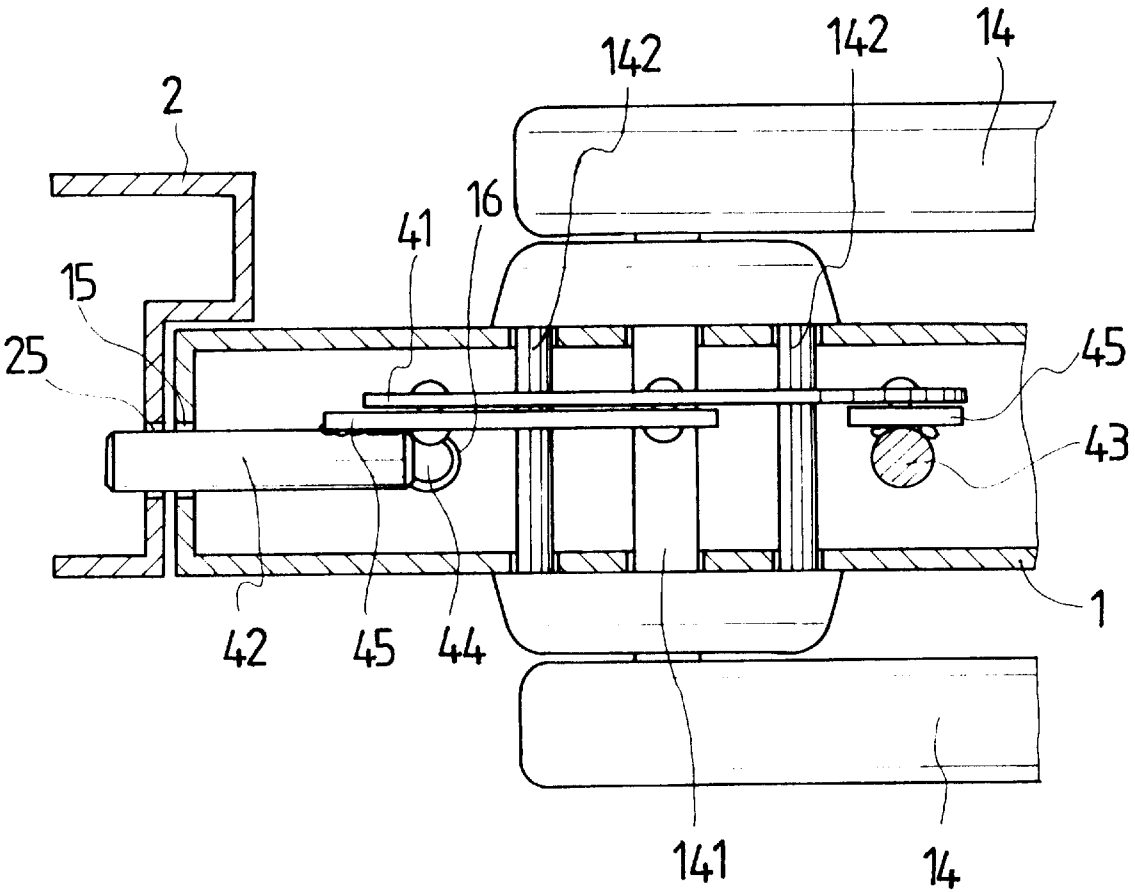
FIG. 12 is a partial cross sectional view showing the arrangement of the retaining mechanism of FIG. 10.

As can be seen from FIGS. 11 and 12, the latching device 4 is made up of a disk 41, a transverse lock rod 42, an upper lock rod 43, and a lower lock rod 44. The disk 41 is a flat circular plate. The disk is symmetrically provided at two sides with a bowed slot 411. The transverse lock rod 42 is a round bar, with one end pivotally and horizontally connected to the upper portion of the disk 41. The upper lock rod 43 is a long round bar vertically pivotally attached to one side of the disk 41. The lower lock rod 44 is also a long round bar that extends vertically downwards to pivotally couple with one side of the disk 41. The transverse lock rod 42, the upper lock rod 43, and the lower lock rod 44 are individually linked to the disk 41 through a long plate-like link rod 45. The link rod 45 is provided with an elongated round hole 451 at one end. A rivet extending through the elongated hole 451 fastens these link rods 45 on the disk 41. Each lock rod 42, 43, and 44 is annexed at one end to one link rod 45 by welding.

Figure 13:
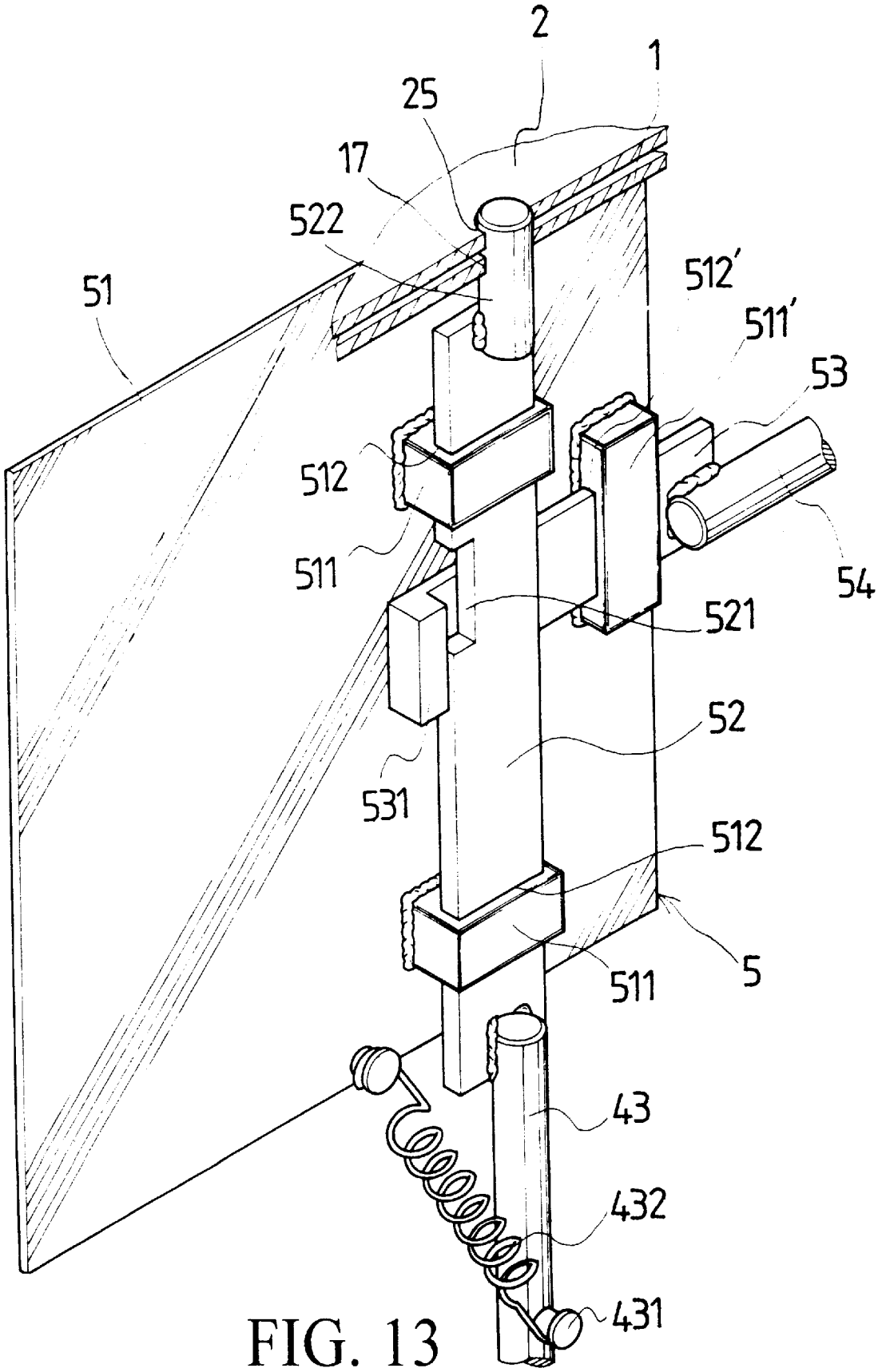
FIG. 13 is a perspective view showing the actuating mechanism of the invention.

The actuating device 5 shown in FIG. 13 comprises a base plate 51, a slide plate 52, a stopper plate 53, and an actuating rod 54. The base plate 51 is a thin plate with two guide blocks 511 symmetrically welded on one side surface. The two guide blocks 511 individually have a rectangular through opening 512 facing toward the vertical direction and are aligned in a line. Another guide block 511' is disposed near the two blocks 511 and has a rectangular hole 512' facing in a horizontal direction. The slide plate 52 is a long flat piece with a rectangular notch 521 on one side edge and movably extends through two rectangular openings of the vertically arranged guide blocks 511. The slide plate 52 is affixed by welding the lower end to the upper lock rod 43 of the latching device 4 and soldering the upper end to a latch bar 522. The stopper plate 53 is also a long flat piece movably extending through the rectangular hole 512' of the guide block 511' to form an interlocking mechanism in cooperation with the slide plate 52. The front end of the stopper plate 53 includes a block 531, which is dimensioned to match with the rectangular notch 521 to lock the side plate 52. The actuating rod 54 is a long bar with one end connected to the stopper plate 53 by welding.

The retaining plate 3 is arranged inside a groove 23 of the door frame 2 by means of extending pivot pins 35 at the upper and the lower end of the retaining plate 3 through the axle holes 24 of the door frame 2. The plate springs 36 fixed on the side surface of the retaining plate 3 press against the interior surface 231 of the groove 23 to make the retaining plate 3 stay in the groove 23. Hence the door leaf 1 can be closed smoothly. In addition, as can be seen from FIG. 2, the door leaf 1 squeezes the rubber packing 32 of the retaining plate 3 to make the retaining plate 3 rotate in the groove 23. As a result, the mating portion 34 of the retaining plate 3 engages with the recessed groove 12 of the door leaf to secure the door leaf 1 in a closed position. This can provide the advantage of preventing the door leaf from being forced to open by an external force applied at the gap between the door leaf 1 and the door frame 2. The close engagement of the mating portion 34 with the groove of the door leaf 1 helps the door leaf 1 to enhance the effect of protection against fire and smoke when the door is closed.

Figure 3:
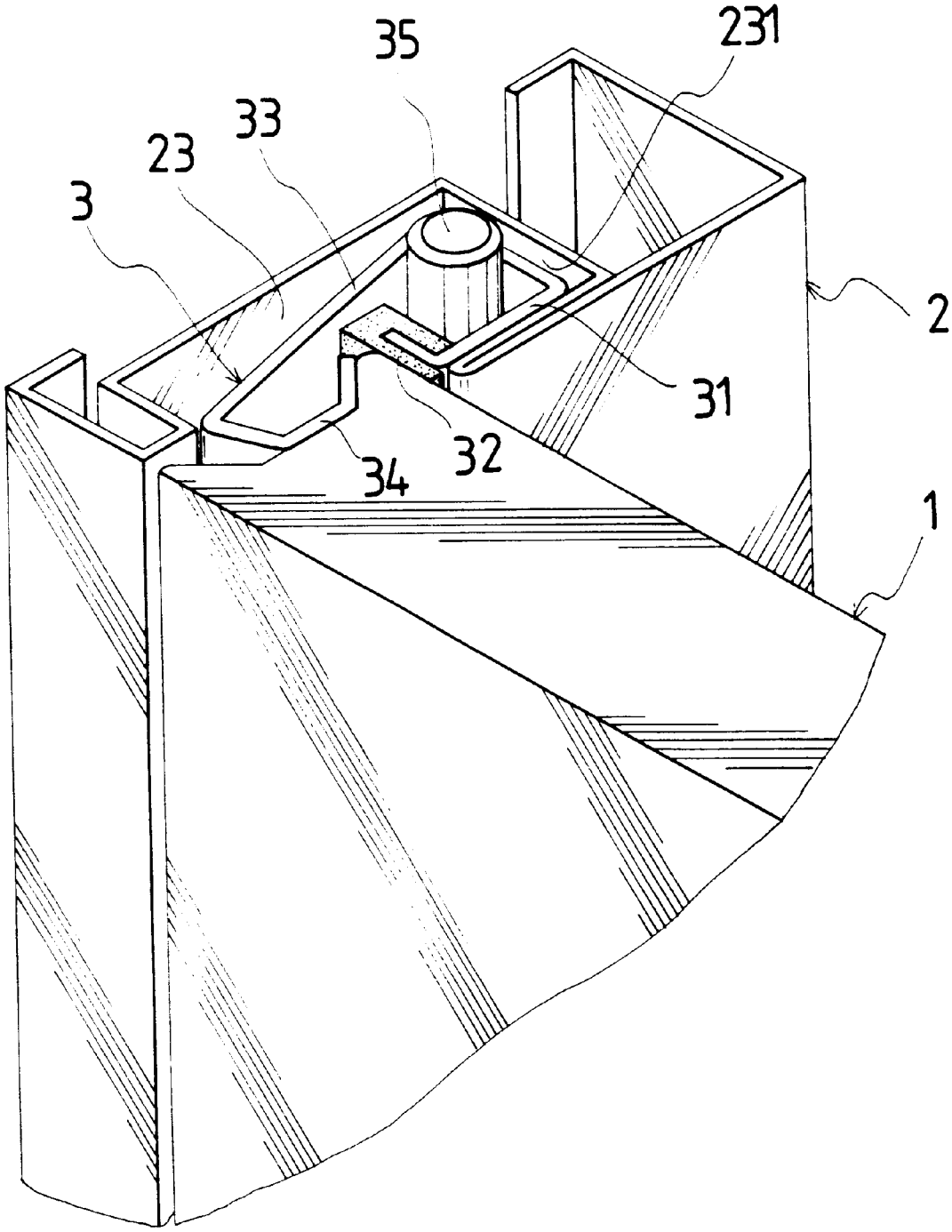
FIG. 3 is a perspective view partially showing the door leaf, the door frame and the retaining plate in an assembled state.
Figure 4:
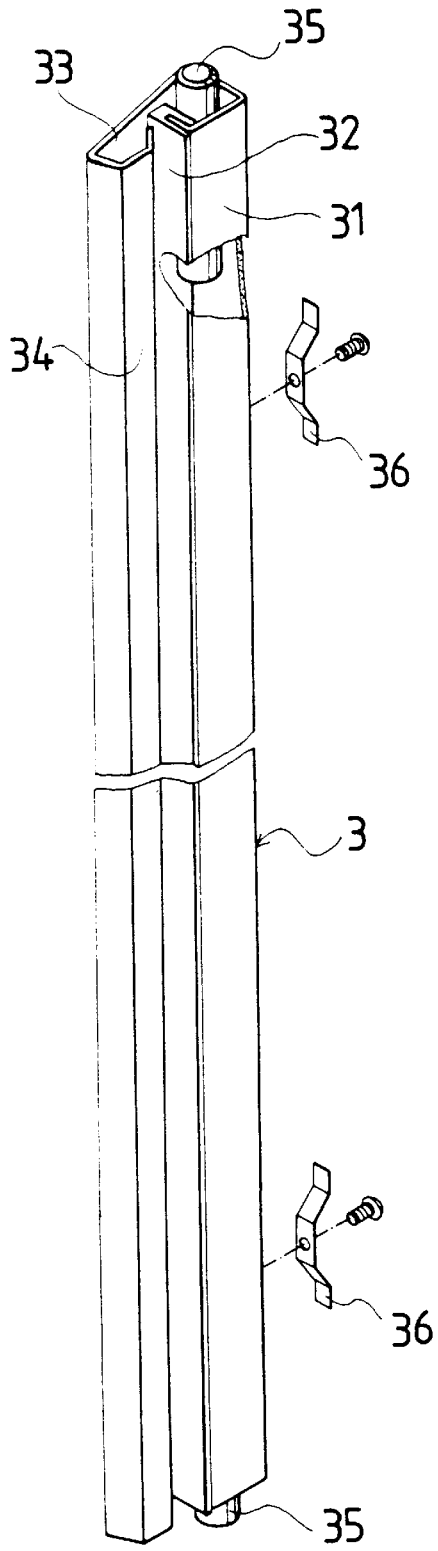
FIG. 4 is an exploded view showing the retaining plate and trapezoidal plate springs according to the invention.
Figure 5:
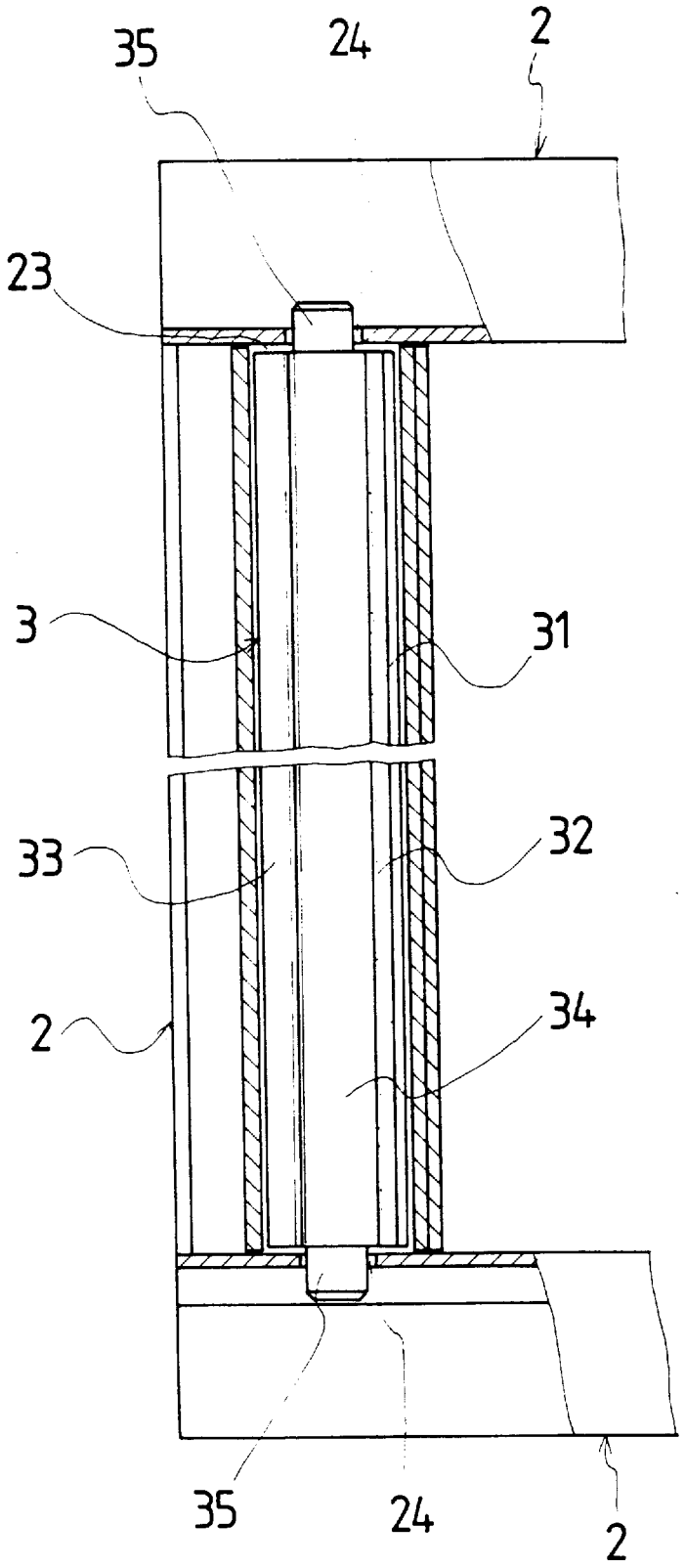
FIG. 5 is a partial cross sectional view taken along the groove side of the door frame showing the retaining plate pivotally attached to the door frame.
Figure 6:
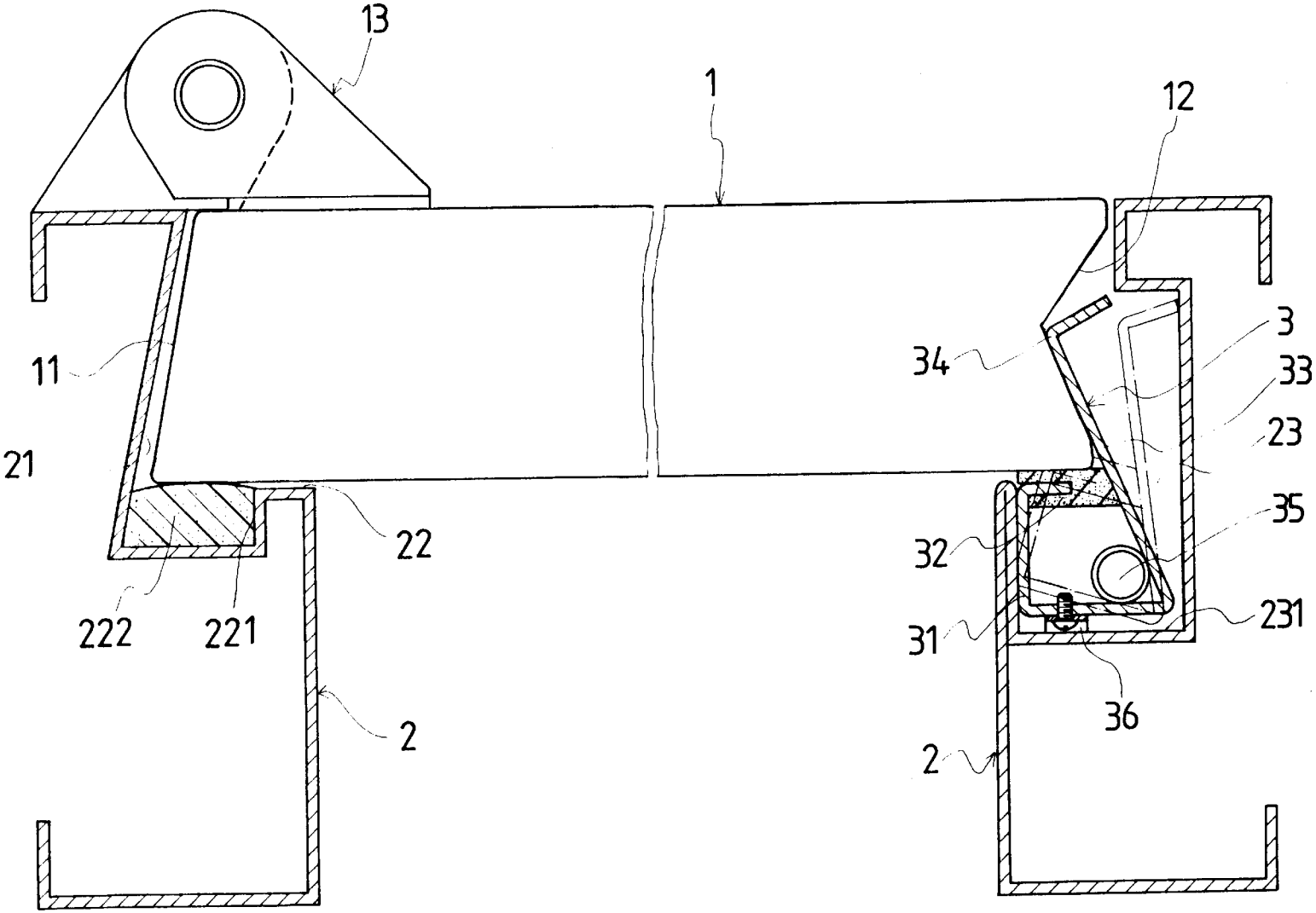
FIG. 6 is a partial cross sectional view taken along the header of the door frame showing another embodiment of a door leaf, a door frame, and a retaining plate according to the invention in an assembled state.
Figure 7:
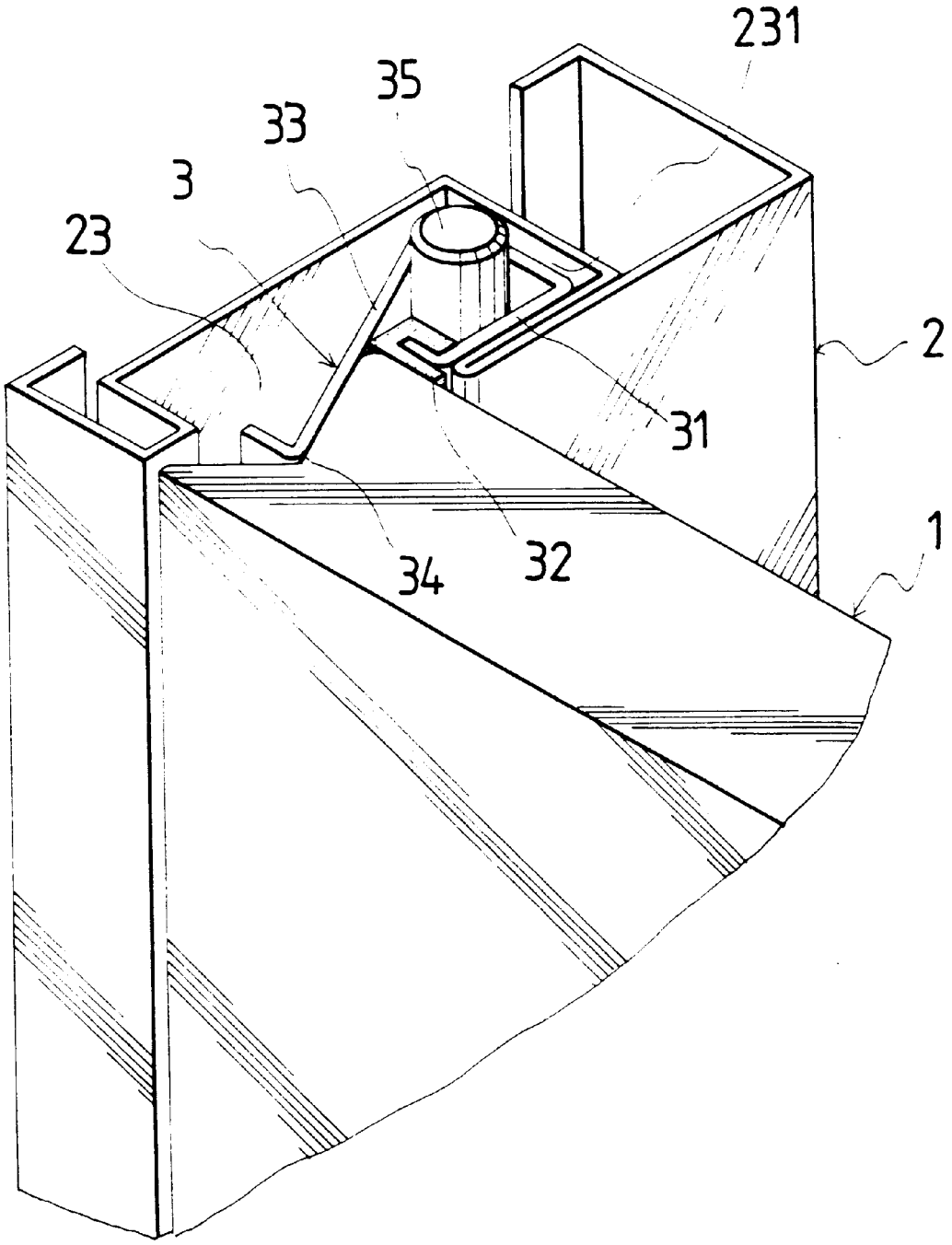
FIG. 7 is a perspective view partially showing the door leaf, the door frame and the retaining plate of FIG. 6.
Figure 8:
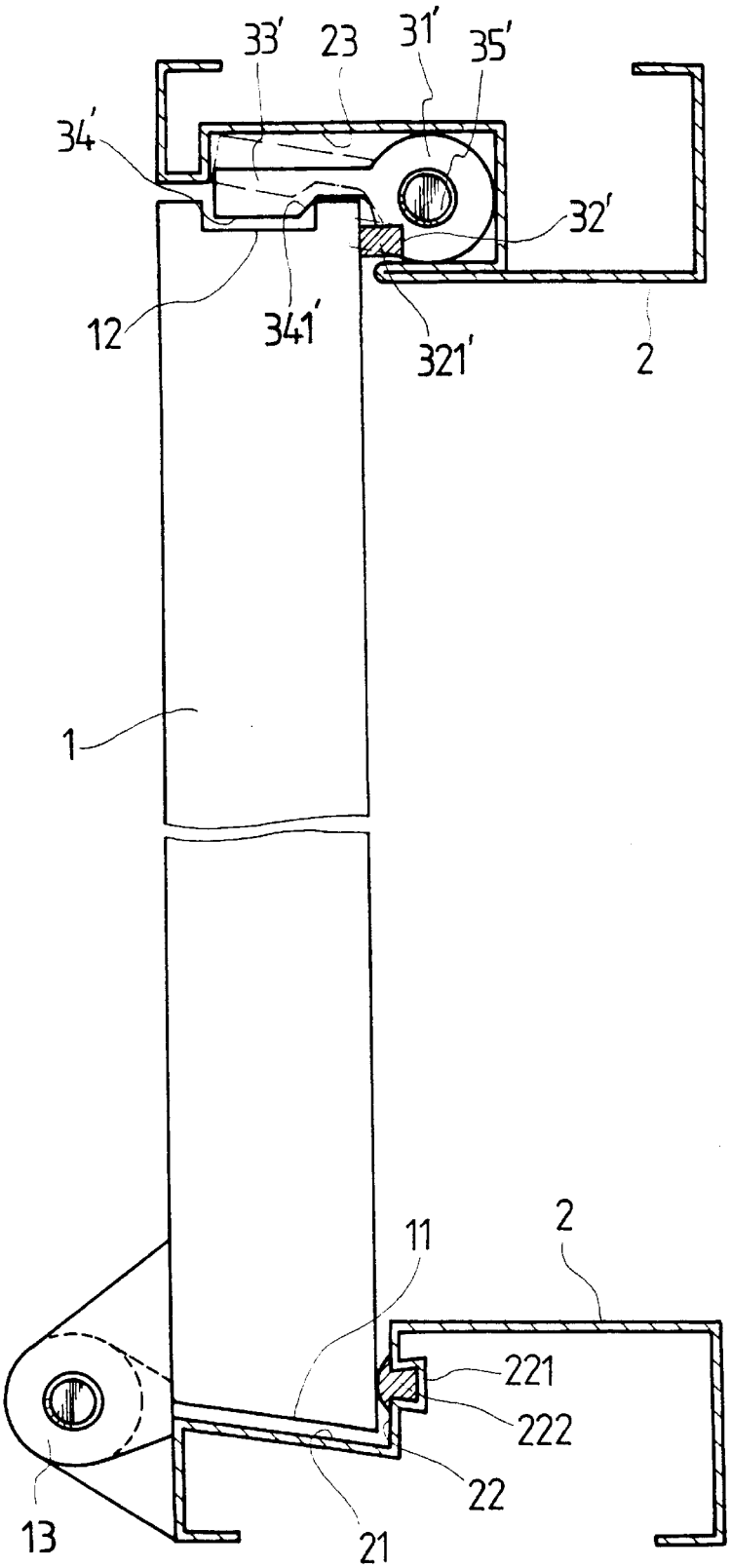
FIG. 8 is a partial cross sectional view taken along the header of the door frame showing the third embodiment of a door leaf, a door frame, and retaining plate according to the invention in an assembled state.
Figure 9:
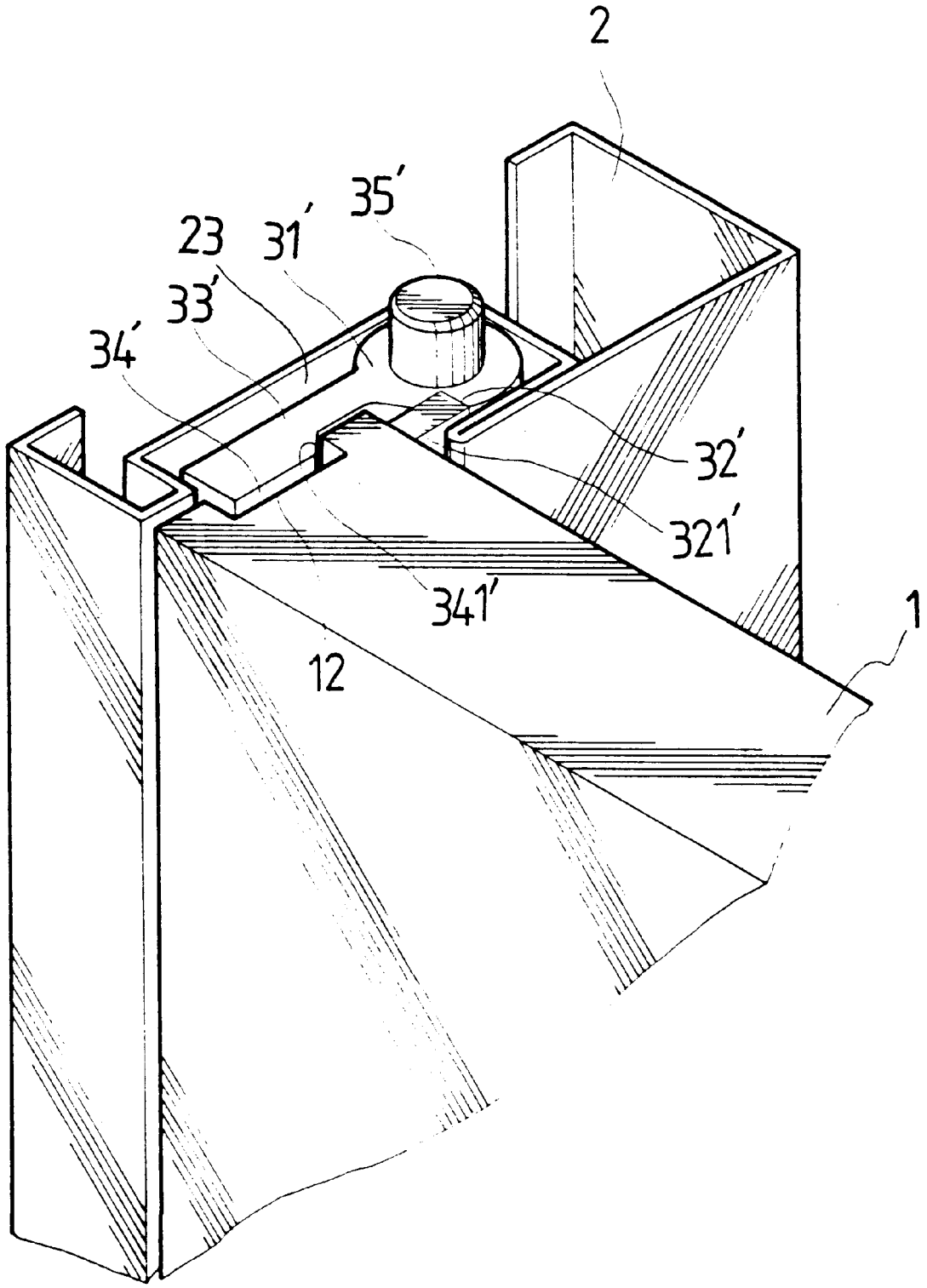
FIG. 9 is a perspective view partially showing the door leaf, the door frame, and the retaining plate of FIG. 8.

As to the configuration of the retaining element 3, the mating portion 34 extending from the retaining portion 33 must match with the groove 12 of the door leaf 1. As shown in FIGS. 2 through 4, the mating portion 34 is configured to have a barb-like shape, which is generally trapezoidal. Thus the groove 12 of the door leaf 1 is also trapezoidal in configuration, which corresponds to the shape of the mating portion 34. FIGS. 6 and 7 show another embodiment of a retaining element 3 according to the invention. The slant surface of the retaining portion 33 of the retaining element 3 forms the mating portion. Consequently the door leaf 1 also has a V-shaped groove 12 so that the slant surface of the retaining portion 33 can detain the V-shaped groove 12. Further, as can be seen from FIG. 4, the trapezoidal plate springs 36 on the external wall surface of the supporting portion 31 of the retaining element 3 can retract the retaining element 3 into the groove 23 of the door frame 2 when the door is open and can prevent the retaining portion 33 from collision with the door leaf 1 when closing the door. Thus the door leaf 1 can squeeze the resilient packing 32 on the supporting portion of the retaining element 3 by means of the resilient force of plate springs 36 on the back wall surface of the supporting portion 31. FIGS. 8 and 9 indicate another embodiment of a retaining element 3 according to the invention. The retaining element 3' is provided with a round rod portion 31'. The outer surface of the round rod portion 31' extends to form a retaining portion 33' and has a recessed portion 32' provided near the retaining portion 33'. A resilient buffer 321' is arranged inside the recessed portion 32'. Provided between the retaining portion 33' and the door leaf 1 is an engaging portion 341' that has a slant surface 341' formed on the inner side thereof. The upper and the lower end of the retaining element 3' are individually provided with a pivot pin 35' on the central axle. With this arrangement, the door structure can achieve the same effect.

The latching device 4 and the actuating device 5 of the lock mechanism inside the door leaf 1 are shown in FIGS. 10, 11, 12 and 14. The disk 41 of the latching device 4 is mounted on the rotary axle 141 of the door handle 14 so that the disk 41 can be rotated by turning the door handle 14. The door handle 14 has two long pins 142 separately extending into two bowed slots 411 on the disk 41. The bowed slots 411 keep the rotation of the disk 41 within a predetermined range. The transverse lock rod 42 extends through the transverse latch hole 15. The top end of the upper lock rod 43 is welded to a slide plate 52 of the actuating device 5 and is provided on the rod body with a short pin 431, to which a tension spring 432 is connected. The other end of the tension spring 432 is attached to the base plate 51. The lower lock rod 44 extends through the lower latch hole 16 on the lower side of the door leaf 1. The base plate 51 of the actuating device 5 is fixed on the upper corner of the door leaf 1 by welding. The lock rod 522 on the upper end of the slide plate 52 extends into the upper latch hole 17 on the upper side of the door leaf 1. The actuating rod 54 is provided with a short pin 541 on the rod body and horizontally of the pivoting side of the door leaf 1, with a tension spring 542 attached to the short pin 541. With the above arrangement, the latching device 4 and the actuating device 5 are housed in the door leaf.

Figure 14:
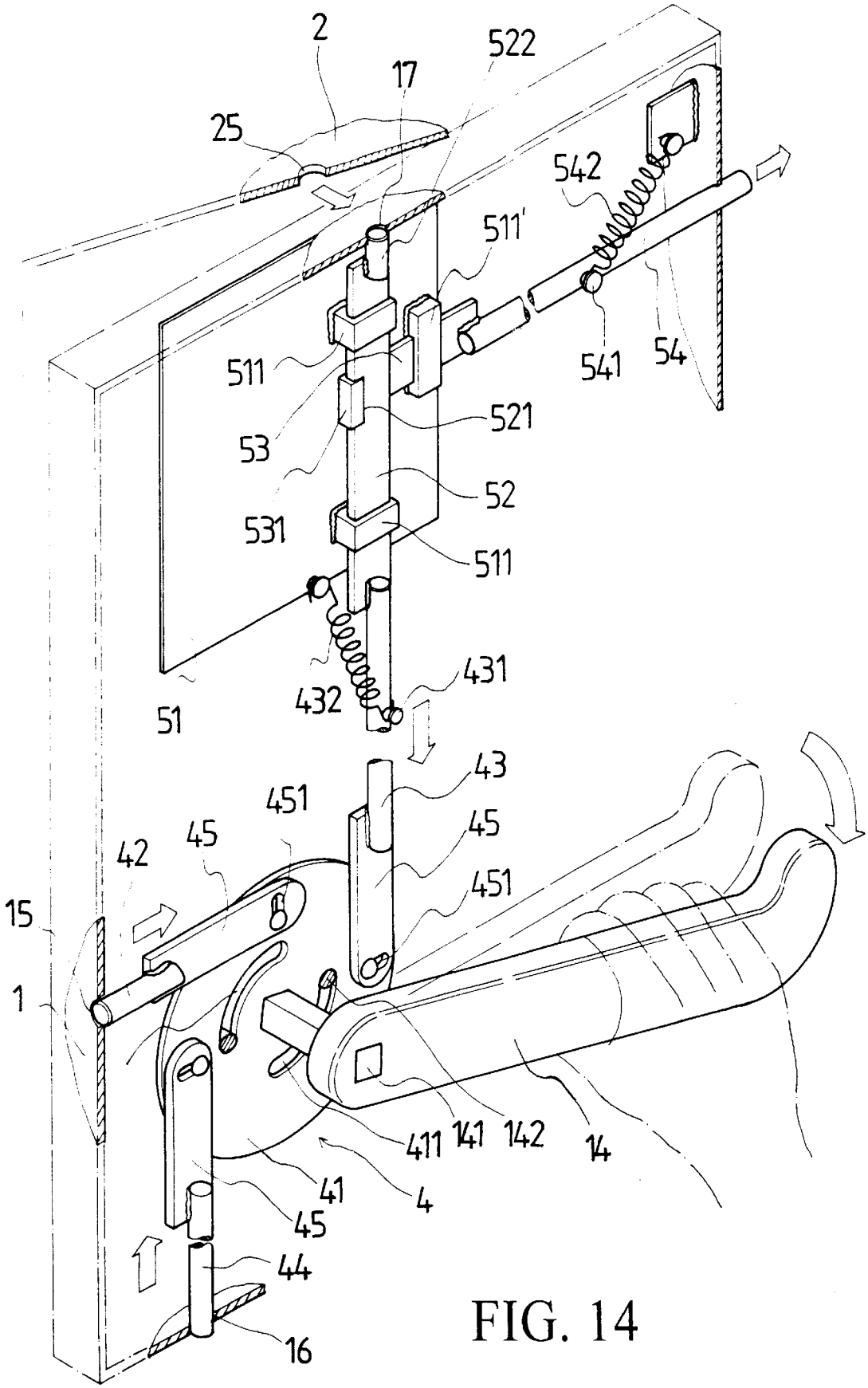
FIG. 14 is a perspective view showing the movement of the retaining mechanism and the actuating mechanism when the door handle is operated.

FIGS. 1 and 14 illustrate the operation of the retaining mechanism according to the invention. When the door leaf 1 is open, the actuating rod 54 of the actuating device 5 is pulled out of the door leaf 1 by the tension spring 542 because the door frame 2 can not press against the actuating rod 54. At the same time the locking portion 531 of the stopper plate 53 falls into the notch 521 of the slide plate 52 to hold the upper lock rod 43. Thus the tension spring 432 attached to the upper lock rod 43 of the latching device 4 can not move the upper lock rod 43 any more. As a consequence, the upper lock rod 522 of the slide plate 52 and the transverse lock rod 42 and the lower lock rod 44 are kept in the door leaf 1.

Figure 15:
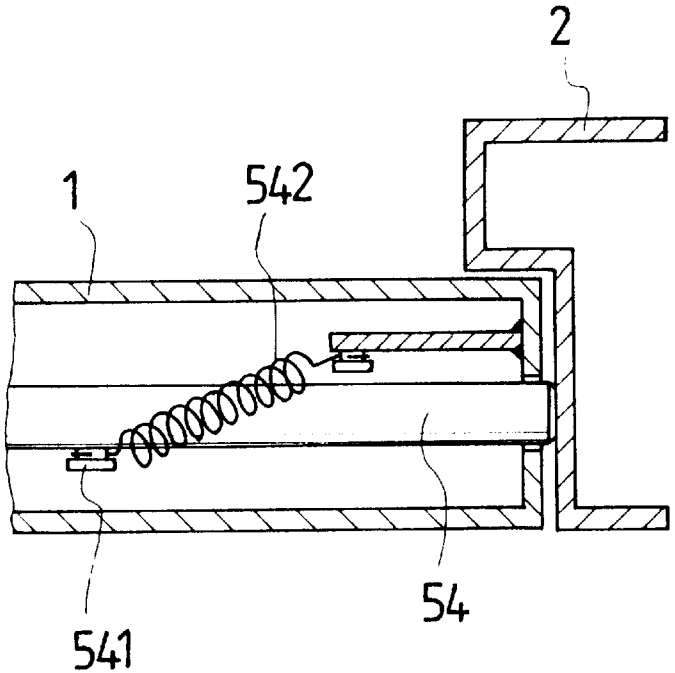
FIG. 15 is a partial cross sectional view illustrating the movement the actuating rod of the invention as the door leaf is closed.

When users close the door leaf 1, the pivoting side of the door leaf 1 abuts against the door frame 2, which urges the actuating rod 54 to move into the door leaf as shown in FIGS. 10 and 15. Then, it brings the stopper plate 53 to move back so that the locking portion 531 disengages with the notch 521. As a result, the tension spring 432 drives the upper lock rod 43 to move, which in turn brings the slide plate 52 to move upwardly until the lock rod 522 protrudes through the upper latch hole 17 of the door leaf 1 and extends into the hole 25 of the door frame 2. When the upper lock rod 43 moves, the disk 41 is urged to rotate. This makes the transverse lock rod 42 and the lower lock rod 44 of the holes 15 and 16 of the door leaf and extend into the holes 25 of the door frame 2. Thus the door structure according to the invention can achieve a multiple lock effect.

Figure 16:
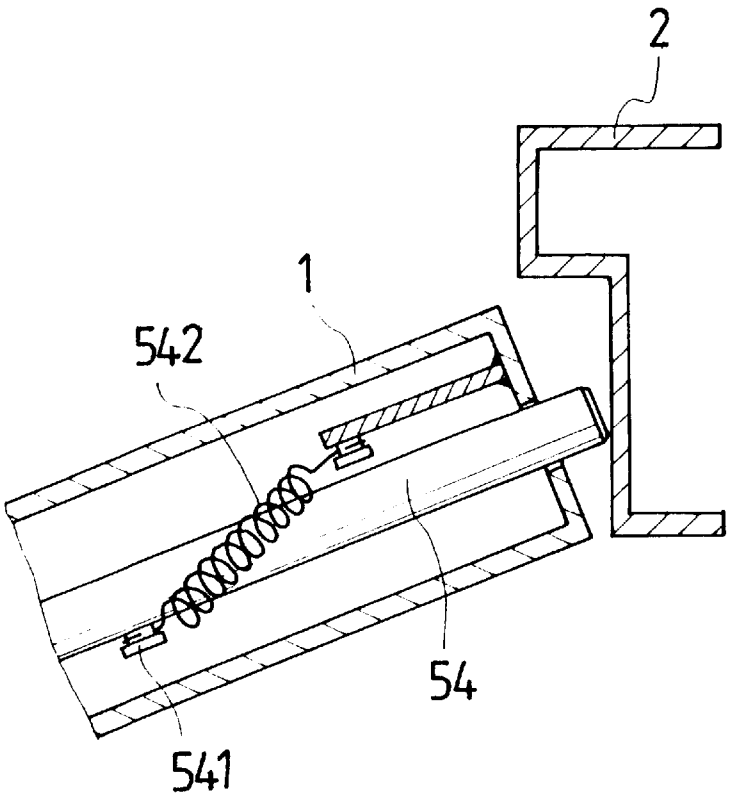
FIG. 16 is a partial cross sectional view illustrating the movement of the actuating rod as the door leaf is opened.
Figure 17:
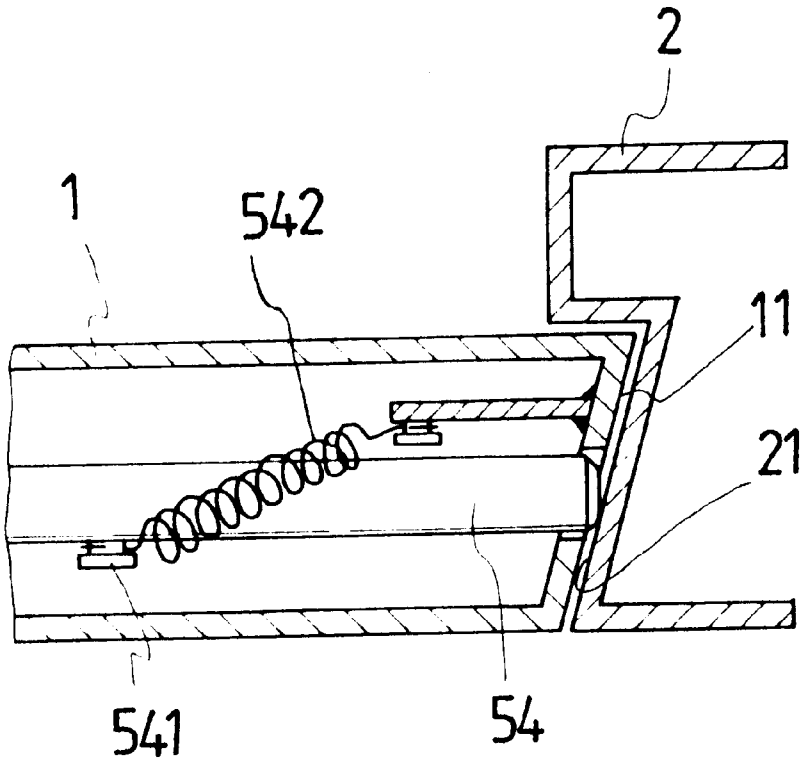
FIG. 17 is another partial cross sectional view indicating the mating arrangement of the slant surfaces of the door frame and the door leaf.

When users depress the door handle 14 and open the door leaf 1, the lock rods of the latching device 4 retract into the door leaf 1 due to the rotation of the disk 41. The actuating rod 54, freed from the constraints of the door frame 2, is pulled out of the door leaf 1 by the tension spring 542 again as shown in FIG. 16. The locking portion 531 of the stopper plate 53 falls into the notch 521 again to keep the lock rods of the latching device 4 in the door leaf 1. Therefore, the door structure according to the invention has an automatic and multiple lock effect, thus preventing undesirable invasion.

Although the preferred embodiments of the invention have been disclosed for illustrative purposed, those skilled in the art will appreciate that various modifications, additions and substitutions are possible, without departing from the scope and spirit of the invention as disclosed in the accompanying claims.

What is claimed is:

1. A door structure comprising:

a door leaf with a wedged surface formed on a side for pivotal connection and a groove disposed on a surface of an opposite side, a rectangular door frame with an angled surface formed on an inner periphery on a side thereof and a long groove disposed on an opposite side thereof;

a retaining plate including a steel sheet with a supporting portion formed on a first end, an inclined retaining portion extending from a second end, and a mating portion extending from said retaining portion and sized to engage with the long groove of said door leaf; and wherein said retaining plate is pivotally attached to the long groove of said door frame so that the retaining plate can rotate to engage the mating portion of said retaining plate with the groove of said door leaf.

2. The door structure as claimed in claim 1, wherein an upper end and a lower end of the long groove of said door frame are each provided with an axle hole.

3. The door structure as claimed in claim 1, wherein an upper end and a lower end of the retaining plate are each provided with a pivot pin.

4. The door structure as claimed in claim 1, wherein the retaining plate is formed from a metal sheet.

5. The door structure as claimed in claim 1, wherein an inner end of the supporting portion of said retaining plate is embraced by a resilient packing.

6. The door structure as claimed in claim 5, wherein the resilient packing embracing the supporting portion of said retaining plate includes a fireproof cotton cloth.

7. The door structure as claimed in claim 1, wherein said retaining plate is provided with a plurality of trapezoidal plate springs on an outer wall surface of the retaining portion, said trapezoidal plate springs pressing against an inner surface of said retaining plate to maintain the plate in the groove of said door frame.

8. The door structure as claimed in claim 1, wherein the mating portion of said retaining plate is trapezoidal and the groove of said door leaf has a corresponding trapezoidal cross section in the transverse direction.

9. The door structure as claimed in claim 1, wherein a slant front surface of the retaining portion of said retaining plate includes a part of the mating portion for engagement with the long groove of the door leaf when the door is closed, and the groove of said door lead has a V-shaped profile in the transverse direction.

10. A door structure comprising:

a door leaf with a wedged surface formed on a side for pivotal connection and a groove disposed on a surface of an opposite side, a rectangular door frame with a wedged surface formed on an inner periphery on a side thereof and a long groove disposed on an opposite side thereof;

a retaining plate including a steel sheet with a supporting portion formed on a first end, an inclined retaining portion extending from a second end, and a mating portion extending from said retaining portion and sized to engage with the long groove of said door leaf;

a retaining mechanism including a latching device and an actuating device disposed inside said door leaf to lock the door leaf to the door frame when the door is closed;

said latching device being a flat disk mounted on an axle of a door handle and able to be rotated by turning the door handle, and further provided with a transverse lock rod, an upper lock rod, and a lower lock rod;

said transverse lock rod being pivotally linked on a first end to an upper portion of said flat disk and having a second end extending through a transverse latch hole on a free side of the door leaf, said upper lock rod being an upright bar pivotally connected to a first side of said flat disk with an upper end extending to couple with said actuating device, said lower lock rod being an upright bar pivotally connected to a second side of said flat disk with the lower end extending to a lower latch hole on a lower side of the door leaf;

said actuating device having a base plate attached to an upper portion of said door leaf and having a lower portion connected to a tension spring, which spring is attached to the upper lock rod of said latching device;

said actuating device including a slide plate connected with the upper lock rod of said latching device;

said slide plate being connected on an upper end thereof to a latch bar that extends through an upper latch hole of said door leaf, and having a rectangular notch formed on a side edge for engagement with a front end of a stopper plate; and said stopper plate being further connected on a rear end thereof to a transverse actuating rod that extends to the pivotal side of said door leaf and is urged outwardly by a tension spring affixed to said door leaf.

11. The door structure as claimed in claim 10, wherein an upper side and a lower side of the groove of said door frame are each provided with an axle hole.

12. The door structure as claimed in claim 10, wherein an upper end and a lower end of the retaining plate are each provided with a pivot pin.

13. The door structure as claimed in claim 10, wherein the retaining plate is formed of metal.

14. The door structure as claimed in claim 10, wherein an inner end of the supporting portion of said retaining plate is embraced by a resilient packing.

15. The door structure as claimed in claim 14, wherein the resilient packing embracing the inner end of the supporting portion of said retaining plate includes a fireproof cotton cloth.

16. The door structure as claimed in claim 10, wherein said retaining plate is provided with a plurality of trapezoidal plate springs on an outer wall surface of the retaining portion, and said trapezoidal plate springs pressing against the inner surface of said retaining plate to maintain the plate in the groove of said door frame.

17. The door structure as claimed in claim 10, wherein the mating portion of said retaining plate is trapezoidal in shape and the groove of said door leaf has a corresponding trapezoidal cross section in the transverse direction.

18. The door structure as claimed in claim 10, wherein a slant front surface of the retaining portion of said retaining plate forms a part of a mating portion for engagement with the groove of the door leaf when the door is closed, and the groove of said door leaf has a V-shaped profile in the transverse direction.

19. The door structure as claimed in claim 10, wherein said transverse lock rod, said upper lock rod, and said lower lock rod are each pivotally linked to a disk of said latching device by a welded link rod, each link rod being fixed on a first end thereof to the lock rod and provided with an elongated hole on a second end thereof, and a rivet fixes each link rod to the disk of the latching device.

20. The door structure as claimed in claim 19, wherein said transverse lock rod, said upper lock rod, and said lower lock rod are each a round bar.

21. The door structure as claimed in claim 19, wherein said latching device has two bowed slots respectively arranged on two sides of the center of the disk, and a door handle having a pair of pins extendible into the slots when the handle rotates the disk.

22. The door structure as claimed in claim 19, wherein said transverse lock rod, said upper lock rod, and said lower lock rod are each a square bar.

23. The door structure as claimed in claim 10, wherein said actuating device has two opposite guide blocks on the base plate, each guide block having a hole therethrough, and the slide plate being movable through the holes of the guide blocks.

* * * * *